US008662146B2

(12) United States Patent
Ikenaga

(10) Patent No.: US 8,662,146 B2
(45) Date of Patent: Mar. 4, 2014

(54) STRUCTURE FOR CASTING

(75) Inventor: Haruki Ikenaga, Aichi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/701,130

(22) PCT Filed: Jun. 24, 2011

(86) PCT No.: PCT/JP2011/064496
§ 371 (c)(1),
(2), (4) Date: Dec. 21, 2012

(87) PCT Pub. No.: WO2011/162365
PCT Pub. Date: Dec. 29, 2011

(65) Prior Publication Data

US 2013/0105103 A1 May 2, 2013

(30) Foreign Application Priority Data

Jun. 25, 2010 (JP) ..... 2010-145199

(51) Int. Cl.
*B22C 1/00* (2006.01)

(52) U.S. Cl.
USPC ..... 164/520; 164/14; 164/33; 164/72; 164/138

(58) Field of Classification Search
USPC ..... 164/14, 33, 72, 138, 349, 410, 164/516–529; 249/114.1; 106/38.22–38.28
See application file for complete search history.

(56) References Cited

U.S. PATENT DOCUMENTS

2008/0105401 A1* 5/2008 Nakai et al. ..... 164/520
2010/0307714 A1 12/2010 Yoshida et al.
2011/0073267 A1* 3/2011 Kloskowski et al. ..... 164/14

FOREIGN PATENT DOCUMENTS

JP 8-257673 A 10/1996
JP 2005-153003 A 6/2005
JP 2007-21578 A 2/2007
JP 2008-142755 A 6/2008
JP 2009-195982 A 9/2009
JP 2010-142840 A 7/2010

OTHER PUBLICATIONS

International Preliminary Report on Patentability for International Patent Application No. PCT/JP2011/064496, dated Jan. 15, 2013.
Machine-Generated Translation for JP-2008-142755-A, published Jun. 26, 2008.
Machine-Generated Translation of JP-2005-153003-A, published Jun. 16, 2005.
Machine-Generated Translation of JP-2007-21578-A, published Feb. 1, 2007.
International Search Report for PCT/JP2011/064496 mailed on Aug. 16, 2011.

* cited by examiner

*Primary Examiner* — Kevin P Kerns
*Assistant Examiner* — Kevin E Yoon
(74) *Attorney, Agent, or Firm* — Birch, Stewart, Kolasch & Birch, LLP

(57) ABSTRACT

The present invention provides a structure for casting containing an organic fiber, an inorganic fiber, inorganic particles (A) having an average particle diameter of 50 to 150 μm, and a binder (a), having a surface layer containing refractory inorganic particles (B) having an average particle diameter of 1 to 100 μm selected from metal oxides and metal silicates, a clay mineral, and a binder (b), on the surface of the structure.

18 Claims, 2 Drawing Sheets

A-A' cross-section

STRUCTURE FOR CASTING

FIELD OF THE INVENTION

The present invention relates to a structure of mold and the like used for casting.

BACKGROUND OF THE INVENTION

Casting generally uses a mold containing a cavity (and a core if necessary) usually made of molding sand. The mold is provided with a pouring cup, a sprue, a runner, and a gate for pouring a molten metal into the cavity (hereinafter, also collectively referred to as a gating system), which are formed so as to lead to the cavity. The mold is further provided with a vent connecting with the outside and a riser or flow off, which are generally made of molding sand together with the mold in a common shape. In some cases, the pouring system is built with a fire-resistant material such as a ceramic tube. There have been proposed methods for casting with a mold having a runner that is a structure containing organic and inorganic fibers and a binder, as described in JP-A2007-21578 and the like. JP-A 2007-21578 describes a structure for casting, that contains organic and inorganic fibers and a binder and is coated with inorganic particles to reduce gas defects in cast steel. JP-A2008-142755 discloses a structure for casting, that has a metal-coated surface with vanadium or the like. JP-A 2009-195982 discloses a structure for casting, that contains at least one kind of inorganic particles selected from amorphous graphite and artificial graphite, inorganic fibers, and a thermosetting resin, and has the gas permeability of 1 to 500. JP-A 08-257673 describes application of a slurry containing a zirconium powder, water, and a silica sol containing silicic anhydride to the surface of a mold. JP-A2010-142840 discloses a structure for casting, that is coated on the surface with a coating liquid composition containing flake graphite and a water-soluble binder containing gum arabic, a phenol resin or aluminium phosphate.

SUMMARY OF THE INVENTION

The present invention relates to a structure for casting, containing an organic fiber, an inorganic fiber, inorganic particles (A) having an average particle diameter of 50 to 150 μm, and a binder (a), having a surface layer containing refractory inorganic particles (B) having an average particle diameter of 1 to 100 selected from metal oxides and metal silicates, a clay mineral, and a binder (b), on the surface of the structure.

The present invention also relates to a method for producing a structure for casting, including steps of:

preparing a structure (I) from a raw slurry containing an organic fiber, an inorganic fiber, inorganic particles (A) having an average particle diameter of 50 to 150 μm, a binder (a) and a dispersing medium through a papermaking-having molding; and forming a surface layer containing refractory inorganic particles (B) having an average particle diameter of 1 to 100 μm selected from metal oxides and metal silicates, a clay mineral, and a binder (b) on the surface of the structure (I).

The present invention further relates to use of the above shown structure for casting for casting a cast article and a process for casting a cast article with the above shown structure.

Figure 1:
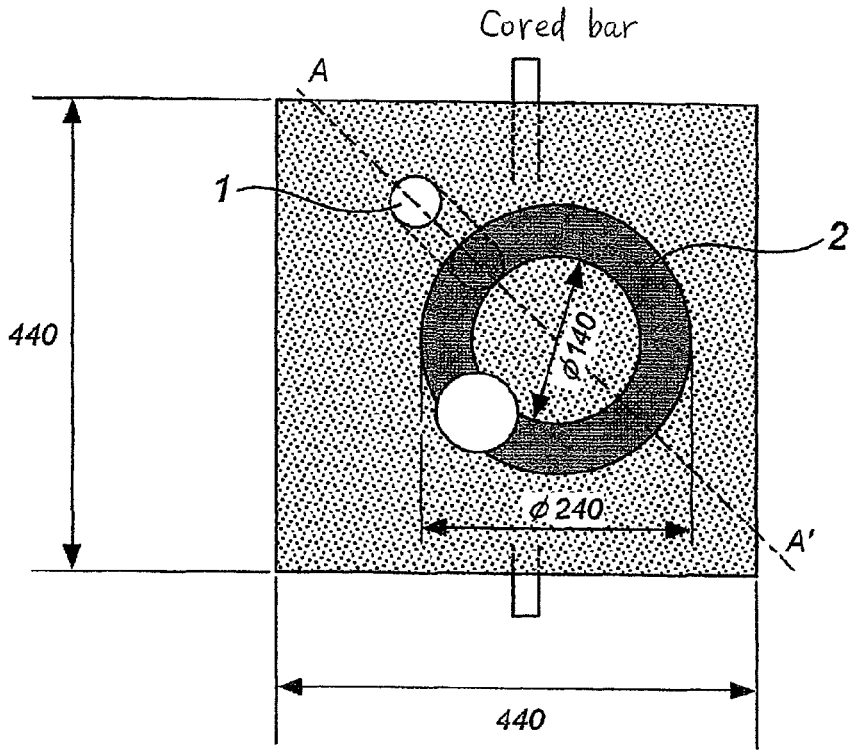
FIG. 1 is a schematic view of a mold used in Examples and Comparative Examples.
Figure 1:
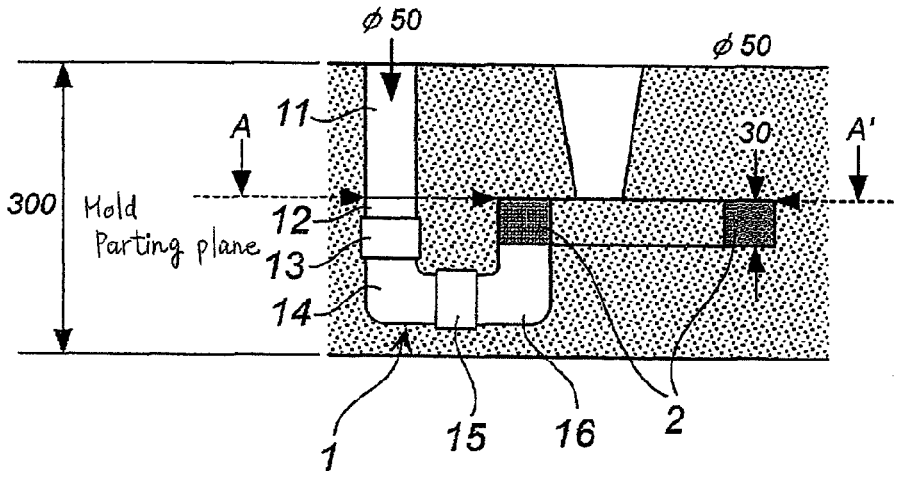

In the drawings, 1 shows a runner for casting and 2 shows a cavity part.

DETAILED DESCRIPTION OF THE INVENTION

The present invention provides the structure for casting that can reduce gas defects, which is one of serious defects in a cast metal. The structure for casting of the present invention has the surface layer at the outer or inner surface. The surface layer blocks pyrolysis gas to reduce gas defects than ever before. Use of inorganic particles having a suitable specific gravity and diameter for the present invention provides good production of the structure having a good gas permeability.

Although methods of JP-A 2007-21578, JP-A 2008-142755 and JP-A 2009-195982 can reduce gas defects, further improvements of effects are needed.

The present invention is to provide a structure for casting that can reduce gas defects, which is one of serious defects in a cast metal.

According to the present invention, a structure for casting that can reduce gas defects is provided.

The structure for casting of the present invention is preferably produced by forming a surface layer containing refractory inorganic particles (B) having an average particle diameter of 1 to 100 μm selected from metal oxides and metal silicates [hereinafter, also referred to as inorganic particles (B)], a clay mineral, and a binder (b) on the surface of a structure [hereinafter, also referred to as structure (I)] containing organic fibers, inorganic fibers, inorganic particles (A) having an average particle diameter of 50 to 150 μm [hereinafter, also referred to as inorganic particles (A)], and a binder (a). The present invention will be described below, based on the preferred embodiments thereof.

The structure (I) according to the present invention has a good gas permeability due to use of the inorganic particles (A) having an average particle diameter of 50 to 150 μm, and when used in casting, the gas pressure decreases in a mold, thereby reducing the amount of gas penetrating into a molten metal. Further, the surface layer containing the refractory inorganic particles (B) having an average particle diameter of 1 to 100 μm formed on the surface of the structure (I) is thought to prevent a gaseous component generated in the mold from penetrating into a molten metal, thereby preventing gas defects. In addition, enhanced gas permeability of the structure (I) means an increased ratio of voids among materials constructing the structure (I). Penetration of the surface layer containing the inorganic particles (B) into the structure (I) is accordingly facilitated, resulting in enhanced delamination resistance of the surface layer against the structure (I). As used herein, the "structure (I)" sometimes refers the structure for casting of the present invention excluding the surface layer.

The structure (I) of the present invention is preferably produced through steps of preparing a slurry composition (hereinafter, also referred to as a raw slurry) containing organic fibers, inorganic fibers, inorganic particles (A), a binder (a), and a dispersing medium, molding an intermediate of the structure (I) through a papermaking process with a metal mold for papermaking and dehydration molding, and heat-drying with a metal mold. It is also preferably produced through steps of putting the slurry in a casting mold and heating to form. The present invention will be described below, based on preferred embodiments thereof.

<Raw Slurry>

The raw slurry according to the present invention contains organic fibers, inorganic fibers, inorganic particles (A), a binder (a), and a dispersing medium.

(i) Organic Fibers

Organic fibers in the structure (I) make up a skeleton of the structure (I) before used in casting. In casting, a part or whole of organic fibers burn with heat of a molten metal to form a cavity in the structure after casting.

Examples of the organic fibers include wood pulps, fibrillated synthetic fibers, and recycled fibers (e.g., rayon fiber). These fibers may be used alone or in combination of two kinds or more. Among them, preferred are paper fibers, because these fibers can be molded into various shapes by papermaking to provide a molded article having good green strength after dehydration and drying, and are easily and stably available and economical. Paper fibers include wood pulps, as well as cotton, linter, and non-wood pulps such as bamboo and straw pulps. Virgin and waste paper (recycled) pulps may be used alone or in combination of two kinds or more. From the viewpoints of availability, environmental protection, and production cost, waste paper pulps are preferred.

Organic fibers preferably have an average fiber length of 0.8 to 2 mm, more preferably 0.9 to 1.8 mm, and even more preferably 0.9 to 1.5 mm. Organic fibers having an average fiber length of not less than 0.8 mm provide a molded article having no crack on the surface and good mechanical properties such as impact strength. Organic fibers having an average fiber length of not more than 2 mm provide a molded article having little unevenness in wall thickness and good surface smoothness.

From the viewpoints of easy production of the structure and effects for reducing gas generation, a content of organic fibers in 100 parts by mass of the structure (I) is preferably not less than 1 part by mass to less than 40 parts by mass, more preferably 2 to 30 parts by mass, even more preferably 5 to 25 parts by mass, and still even more preferably 10 to 20 parts by mass. The content not less than 1 part means a sufficient amount of organic fibers for making up a skeleton of a structure in the raw slurry, and successful production of the structure having sufficient mechanical strength after dehydration and drying can be achieved. At the content less than 40 parts, the produced structure decreases a potential of generating a large amount of combustion gas in casting, and blow back of a molten metal from a sprue and/or flames burning from a flow off (a rod-shaped thin cavity provided on the top of a mold, through which a molten metal rises over a superior part of the mold after the mold has been filled up) can be more easily controlled. As a result, a cast metal has reduced gas defects and improved quality. For improving production of the structure and from the viewpoints of stability of supply and economic efficiency, waste papers (e.g., newspapers) are preferably used as organic fibers.

(ii) Inorganic Fibers

The inorganic fiber is a main component of the structure before used in casting. In casting, the inorganic fiber does not burn with heat of a molten metal, but retains in their shape. When using an organic binder as described below, the inorganic fiber prevents thermal contraction due to pyrolysis of the organic binder with heat of a molten metal.

Examples of the inorganic fibers include carbon fibers, artificial mineral fibers such as rock wool, ceramic fibers, and natural mineral fibers. These fibers may be used alone or in combination of two kinds or more. From the viewpoint of prevention of thermal contraction described above, among these fibers, preferred are carbon fibers having high mechanical strength at such high temperature as metal melts. For saving a production cost, rock wool is preferably used.

Inorganic fibers preferably have an average fiber length of 0.2 to 10 mm, more preferably 0.5 to 8 mm, and even more preferably 2 to 4 mm. Inorganic fibers having an average fiber length of not less than 0.2 mm well pass water and have no possibility of dehydration defects in producing a structure, and are also suitably used to produce a thick structure, for example a hollow 3-dimentional article such as a bottle, through a papermaking process. Inorganic fibers having an average fiber length of not more than 10 mm can provide a structure having a uniform wall thickness and make the production of a hollow structure easier.

A content of inorganic fibers in 100 parts by mass of the structure (I) is preferably 1 to 80 parts by mass, more preferably 2 to 40 parts by mass, even more preferably 5 to 35 parts by mass, and still even more preferably 8 to 20 parts by mass. At the content not less than 1 part by mass, a structure produced with an organic binder has a sufficient mechanical strength in casting, and has no possibility of contraction, cracking, or wall detachment (phenomenon in which a wall of the structure separates into an inner layer and an outer layer) due to carbonization of the organic binder. A defect of a product (cast metal) due to contamination of a part of the structure or molding sand can also be easily prevented. At the content not more than 80 parts by mass, the production of the structure proceeds successfully in the steps of papermaking and dehydration, and is not so affected by price change according to a kind of fibers used as a raw material.

A mass ratio of inorganic fibers to organic fibers is as follows: when inorganic fibers are carbon fibers, inorganic fibers (carbon fibers)/organic fibers is preferably 0.1 to 50, more preferably 0.2 to 30, and even more preferably 0.5 to 1.0; when inorganic fibers are rock wool, inorganic fibers (rock wool)/organic fibers is preferably 10 to 90, and more preferably 20 to 80. At the mass ratio not more than the upper limit, production of the structure progresses successfully at stages of papermaking and dehydration molding, and a dehydrated structure has sufficient mechanical strength to prevent itself from cracking when released from a papermaking mold. At the mass ratio not less than the lower limit, a structure can control contraction due to pyrolysis of organic fibers and/or an organic binder described below.

For increasing hot strength of the structure for casting and improving production of the structure for casting, inorganic fibers preferably have a major-to-minor axis ratio of 1 to 5000, more preferably 10 to 2000, and even more preferably 50 to 1000.

(iii) Inorganic Particles (A)

The slurry composition according to the present invention contains inorganic particles (A) having an average particle diameter of 50 to 150 μm. Examples of the inorganic particle (A) include refractory aggregate particles such as of graphite, mica, silica, hollow ceramics, and fly ash. For inorganic particles (A), these particles may be used alone or in combination of two kinds or more. As used herein, the "hollow ceramics" refers to hollow particles contained in fly ash, and can be separated from fly ash by floatation with water.

For enhancing gas permeability of the structure (I), inorganic particles (A) has an average particle diameter of not less than 50 μm, preferably not less than 60 μm, more preferably not less than 70 μm, and even more preferably not less than 80 μm, and for improving production of the structure (I), not more than 150 μm, preferably not more than 130 μm, more preferably not more than 100 μm, and even more preferably not more than 90 μm. With inorganic particles (A) having an average particle diameter of not less than 50 μm, the produced structure (I) has a good gas permeability and a gas pressure in a mold is adequately reduced in casting. By an increased gas permeability of the structure (I), voids are increased among materials constructing the structure (I) and penetration of a coating liquid composition into the structure (I) is accordingly facilitated, resulting in an enhanced delamination-resistance of the surface layer against the structure (I). With inorganic particles (A) having an average particle diameter of not more than 150 μm, an inorganic particle (A) is hardly exposed on the surface of the produced structure (I) and moldability of the structure (I) is improved.

From the viewpoint of dispersibility of a raw material, inorganic particles (A) preferably have an apparent specific gravity of 0.5 to 2.2, and for weight saving, more preferably 0.5 to 1.5, and even more preferably 0.5 to 1. The "apparent specific gravity" refers to a specific gravity of a hollow particle, based on the presumption that the volume of the hollow particle includes an inner hollow part. In the case of a solid particle having no inner hollow part, an apparent specific gravity is equal to a true specific gravity. Inorganic particles (A) having an apparent specific gravity within this range are well dispersed in the raw slurry prepared with water as a dispersing medium in a papermaking process. In addition, the structure (I) produced from the raw slurry advantageously has a reduced mass and is easier to handle. A composition of the structure (I) can be determined with consideration for an apparent specific gravity as well as a bulk specific gravity of inorganic particles (A). The "bulk specific gravity" is the mass per unit volume of particles determined by placing particles in a vessel having a specified volume at a specified state and measuring the amount of particles.

Inorganic particles (A) may be hollow. Inorganic particles having a large apparent specific gravity can have a small specific gravity in the form of hollow particle.

In the case of inorganic particles (A) having an apparent specific gravity more than 1, an average particle diameter of inorganic particles (A) is determined as follows: first, inorganic particles (A) is subjected to the following first method of measurement; if the resultant value is 200 μm or larger, it is considered as the average particle diameter; if the resultant value is smaller than 200 μm, inorganic particles (A) is subjected to the following second method of measurement, and the result is considered as the average particle diameter. In the case of the apparent specific gravity being not more than 1, the first method is employed.

[First Method of Measurement]

Particle diameters are measured in accordance with a method defined in JIS Z2601 (1993) "Method for determining foundry molding sand properties" Annex 2. A diameter at which an accumulated volume of particles accounts for 50% of the total volume is considered as an average particle diameter. The "accumulated volume" is calculated based on the presumption that particles remaining on a sieve have an "average diameter Dn (mm)" shown in JIS Z2601 (1993), explanatory Table 2.

[Second Method of Measurement]

A laser diffraction particle size distribution analyzer (Horiba, Ltd., LA-920) is used. A diameter at which an accumulated volume of particles accounts for 50% of the total volume is considered as an average particle diameter. Measurement conditions are as follows:

measurement method: flow method reflective index: varying according to a kind of inorganic particles (see the manual supplied with LA-920)

dispersing medium: appropriately selected according to a kind of inorganic particles method of dispersing: ultrasonic agitation with an embedded device (22.5 kHz), for three minutes sample concentration: 2 mg/100 $cm^3$ For increasing hot strength, a content of inorganic particles (A) in 100 parts by mass of the structure (I) is preferably 10 to 80 parts by mass, more preferably 12 to 75 parts by mass, and even more preferably 30 to 70 parts by mass.

(iv) Binder (a)

In the present invention, as the binder (a), an organic binder and/or an inorganic binder may be used. An organic binder is preferred because it has good properties in removal after casting. Examples of the organic binder include thermosetting resins such as phenol resins, epoxy resins, and furan resins. Among these resins, preferred are phenol resins, because phenol resins produce a small amount of flammable gas, have combustion-suppressing effects, and have high residual carbon ratio after pyrolysis (carbonization).

Examples of the phenol resin include Novolac phenolic resins, resol phenolic resins, and urea-, melamine-, and epoxy-modified phenolic resins. Among these resins, resol phenolic resins are preferred, because they require no curing agent such as an acid and an amine, and can reduce an odor generated in molding the structure (I) and reduce cast defects in casting with the structure (I) as a mold.

To use a Novolac phenolic resins, a curing agent must be used together. The curing agent is easy to dissolve in water, and thus preferably applied on the surface of the dehydrated structure (I). As the curing agent, preferably used is hexamethylenetetramine or the like.

An inorganic binder may also be used, including a phosphate binder, water glass such as a silicate, gypsum, a sulfate, a silica binder, a silicon binder, and the like. The organic binder may be used alone or together with one or more other organic binders. The organic binder and the inorganic binder may be used together.

For strongly binding organic fibers, inorganic fibers, and inorganic particles (A) in drying and molding a structure produced through papermaking before used in casting, the binder (a) preferably has a decreasing rate of not more than 50% by mass, and more preferably not more than 45% by mass at 1000° C. in nitrogen atmosphere (according to TG thermoanalysis).

For enhancing strength retention and inhibitory effects against gas generation, a content of the binder (a) in 100 parts by mass of the structure (I) is preferably 5 to 50 parts by mass, more preferably 10 to 40 parts by mass, and even more preferably 10 to 30 parts by mass.

A reason for increasing an amount of gas generated in casting is principally organic fibers and the organic binder. Thus, the kind, the amount and the mass proportion of the two components are important.

A structure formed from the raw slurry containing the binder (a) in an appropriate amount is prevented from adhering to a metal mold during drying after papermaking and is easily separated from the metal mold. Thus, the adhesion of the cured binder (a) can be reduced to the surface of the metal mold, the structure has an increased accuracy of dimension, and surface-cleaning of the metal mold can be less often required.

(v) Dispersing Medium

Examples of the dispersing medium used in the raw slurry according to the present invention include water and solvents such as ethanol, methanol, dichloromethane, acetone, and xylene. These media may be used alone or in combination of two kinds or more. Among them, preferred is water, because it is easy to use.

(vi) Other Components

The structure (I) of the present invention contains organic fibers, inorganic fibers, inorganic particles (A), and the binder (a), and optionally a reinforcing agent for paper. The reinforcing agent for paper prevents an intermediate mold of the structure (I) from swelling when the intermediate is impregnated with the binder (a) (described below).

Examples of the reinforcing agent for paper include latices, acrylic emulsions, polyvinyl alcohols, carboxymethylcelluloses (CMC), polyacrylamide resins, and polyamide-epichlorohydrin resins.

An amount of the reinforcing agent for paper used is, as a solid content, preferably 0.01 to 2 parts by mass, and more preferably 0.02 to 1 part by mass in 100 parts by mass of the structure (I). The reinforcing agent for paper used in an amount of not less than 0.01 parts by mass achieves sufficient effects for preventing the swelling, resulting in appropriate adhering of the added powder to fibers. If the reinforcing agent for paper is used in the amount of not more than 2 parts by mass, the resultant molded structure will difficultly adhere to a metal mold.

The structure (I) of the present invention can further contain other component such as a coagulant and a colorant.

The structure (I) can have any thickness according to an intended use and the like, except that at least a part contacting with a molten metal preferably has a thickness of 0.2 to 5 mm, more preferably 0.4 to 4 mm, even more preferably 1.5 to 2.5 mm, and still even more preferably 1.8 to 2.1 mm. The structure (I) having a thickness of not less than 0.2 mm at the contacting part has a sufficient strength as the structure, and can retain its shape and function desired to the structure against a pressure of molding sand. The structure (I) having a thickness of not more than 5 mm at the contacting part has adequate gas permeability, and can be produced at a reduced raw material cost in a shortened amount of molding time, thereby reducing a production cost.

In a state before covered with the surface layer, the structure (I) preferably has a compressive strength of not less than 10 N, and more preferably not less than 30 N. The structure (I) having a compressive strength of not less than 10 N is hardly deformed in the force of pressure from molding sand and can retain its function as the structure.

In cases of using the raw slurry containing water to produce the structure (I), a water content of the structure (I) before use (before used in casting) is preferably not more than 10% by mass, and more preferably not more than 8% by mass, because the lower water content results in the less amount of gas generated due to pyrolysis in casting. After formation of the surface layer, the structure (I) also preferably has a water content within the range. Thus, the structure for casting of the present invention preferably has a water content of not more than 10% by mass, and more preferably not more than 8% by mass.

The structure (I) preferably has a density of not more than 3 g/cm$^3$, and more preferably not more than 2 g/cm$^3$, because the structure (I) having the lower density has the lighter weight and can be more easily handled and processed.

<Method for Producing Structure (I)>

The method for producing the structure (I) according to the present invention contains subjecting the raw slurry containing organic fibers, inorganic fibers, inorganic particles (A) having an average particle diameter of 50 to 150 μm, a binder (a), and a dispersing medium to a papermaking process to mold into the structure (I).

Next, the method for producing the structure (I) according to the present invention will be described with reference to an embodiment of production of a hollow structure by the method including a papermaking process, which is preferred for successful production of the structure (I). The method preferably includes a step of subjecting a fiber laminate containing a thermosetting resin as the binder (a), and organic fibers, inorganic fibers, and inorganic particles (A) to a heat treatment at 100 to 300° C.

First, the raw slurry containing organic fibers, inorganic fibers, inorganic particles (A), and the binder (a) at specified proportions is prepared by dispersing these components in a specified dispersing medium. The binder (a) may not be added to the raw slurry but to a molded laminate by impregnation.

In the raw slurry, the total content of organic and inorganic fibers is preferably 0.1 to 4% by mass, more preferably 0.2 to 3% by mass, and even more preferably 0.5 to 1.5% by mass. With the raw slurry having the total content not more than 4% by mass, a molded structure is unlikely to have an uneven thickness, and if it is a hollow structure, has the good inner surface. With not less than 0.1% by mass, a molded structure is avoided from having a thin part locally. In the raw slurry, a content of the binder (a) is preferably 0.1 to 4% by mass, more preferably 0.2 to 3% by mass, and even more preferably 0.5 to 1.0% by mass, and a content of inorganic particles (A) is preferably 0.1 to 10% by mass, more preferably 0.3 to 8% by mass, even more preferably 0.5 to 5% by mass, and still even more preferably 0.8 to 5% by mass.

The raw slurry may further contain other additives such as a reinforcing agent for paper, a coagulant, and a preservative, according to need.

Next, the raw slurry is used to mold into an intermediate of the structure (I) by papermaking.

In the papermaking process for an intermediate mold, a metal mold for papermaking and dehydration molding is used, for example, composed of a set of two parts. These two parts form a cavity corresponding to an external form of the intermediate in the mold by mating each other. A specified amount of the raw slurry is press-injected into the cavity from the upper opening of the mold, thereby pressing the inside of the cavity at a specified pressure. Each part has a plurality of communication holes for providing communication between the outside and the cavity. Then the inner surface of each part is covered with a net having a specified opening. For injecting the raw slurry with pressure, a pressure pump and the like may be used. A pressure applied in injecting the raw slurry is preferably 0.01 to 5 MPa, more preferably 0.01 to 3 MPa, and even more preferably 0.1 to 0.5 MPa.

The inside of the cavity is pressurized as described above, and the dispersing medium in the raw slurry is thus forced out of the mold through the communication holes, while solid components in the raw slurry accumulate on the net covering the cavity to form a uniform fiber laminate on the net. In the fiber laminate thus formed, organic and inorganic fibers form an entangled web, and the binder intervenes across the web. Due to this texture, the fiber laminate has good properties in shape retention even with a complicated shape after drying and molding. In addition, even in the case of forming a hollow intermediate, the raw slurry is fluidized and agitated at a pressure applied to the cavity to be homogenized in the cavity in view of the slurry's concentration, thereby providing a uniformly accumulated fiber laminate on the net.

After the formation of a fiber laminate, the raw slurry is stopped to be injected with pressure but the air is pressed in the cavity to compress and dehydrate the fiber laminate. After the compression ended, an elastic stretchable hollow core (elastic core) is inserted into the cavity by suctioning the cavity through the communication holes. The core is preferably made of a material having good tensile strength, impact resilience, stretchability, and the like, such as urethane, fluorine rubber, silicone rubber, or an elastomer.

Next, a pressurized fluid is supplied into the elastic core in the cavity to expand the elastic core, thereby pushing the fiber laminate on the inner surface of the cavity. The fiber laminate is pushed against the inner surface of the cavity and is shaped to have a transferred shape of the inner surface on the outer surface of the laminate, simultaneously being dehydrated.

Examples of the pressurized fluid for expanding the elastic core include compressed air (heated air), oils (hot oils), and other fluids. A supply pressure of the pressurized fluid is, considering an efficiency of molded article production, preferably 0.01 to 5 MPa, and for efficient production, more preferably 0.1 to 3 MPa, and even more preferably 0.1 to 0.5 MPa. At the supply pressure not less than 0.01 MPa, the fiber laminate is efficiently dried, and has the good surface with a well-transferred geometry. The supply pressure not more than 5 MPa results in a good production and can reduce a size of an apparatus.

As described above, the fiber laminate is pushed from the inside of the fiber laminate on the inner surface of the cavity and therefore the shape of the inner surface of the cavity is accurately transferred to the outer surface of the fiber laminate, even if the shape is complex. Further, even a complicated molded article can be produced without bonding of different parts, and thus a final product has no joint by bonding, nor thick part.

After the shape of the inner surface of the cavity is well transferred to the outer surface of the fiber laminate and the fiber laminate is dehydrated up to a specified water content, the pressing fluid is removed from the elastic core to automatically contract the elastic core down to the original dimensions. The shrunken core is taken out from the cavity, and then the metal mold is split in parts to take the wet fiber laminate having a specified water content. The fiber laminate may also be dehydrated and molded only by pressurizing with compressed air introduced in the cavity without using the elastic core for pushing and dehydrating the fiber laminate.

The dehydrated and molded fiber laminate is then subjected to a step of heat drying.

The step of heat drying uses a metal mold for drying and molding that has a cavity corresponding to the external form of the intermediate. The metal mold is heated to a specified temperature, and the wet fiber laminate after the dehydrating-molding is put in the metal mold.

Next, an elastic core that is the same as that used in the papermaking process is inserted in the fiber laminate, and expanded with a pressurized fluid supplied in the core to push the fiber laminate on the inner surface of the cavity. The elastic core is preferably surface-modified with a fluorine resin, a silicone resin, or the like. A supply pressure of the pressurized fluid is preferably at the same level as that in the dehydration process above. Under this condition, the fiber laminate is heated and dried to obtain the intermediate by drying and molding.

For improving quality of the processed surface and reducing a time of drying, a heating temperature (metal mold temperature) of the metal mold for drying and molding is preferably 100 to 300° C., more preferably 150 to 250° C., and even more preferably 190 to 240° C. The heat treatment time cannot be generalized because it depends on the heating temperature. For improving quality and productivity and the like, it is preferably 0.5 minute to 30 minutes, and more preferably 1 to 10 minutes. With the heating temperature of not more than 300° C., the intermediate has a good surface, and with not less than 100° C., a time for drying the intermediate can be shortened.

After the fiber laminate is sufficiently dried, the pressurized fluid is removed from the elastic core to contract the elastic core. The shrunken core is taken out from the fiber laminate, and then the mold is split in parts to take the intermediate. In the intermediate, the thermosetting resin is cured by the heat treatment, and the intermediate can be used as the structure (I).

The produced structure (I) was pressed with the elastic core and thus has highly smooth inner and outer surfaces. The structure according to the present invention thus has a high size precision even in cases of structures having a screw part and/or an engagement part. The structures can be jointed at such engagement and screw parts to secure inhibition of leakage of a molten metal and provide smooth flow of a molten metal in structures. In addition, the structure contracts in casting at a thermal contraction rate of less than 5%, and can properly inhibit leakage of a molten metal caused by cracking or deformation of the structure.

The resultant intermediate can be further impregnated with the binder (a) partially or completely. In cases of using the binder (a) to impregnate the intermediate therewith not to add in the raw slurry, the raw slurry and white water can be treated more simply. In cases of using a thermosetting binder as the binder (a), the intermediate is heat-dried at a specified temperature to thermally cure the thermosetting binder, thereby accomplishing production of the structure (I).

<Structure for Casting>

The structure for casting of the present invention can be produced by a production method including the step of forming a surface layer on the structure (I) (preferably pre-heat treated at 100 to 300° C., and more preferably at 150 to 250° C.). The structure (I) is preferably produced by the method described above. The method for producing the structure for casting of the present invention thus preferably includes the steps of: molding the raw slurry containing organic fibers, inorganic fibers, inorganic particles (A), the binder (a), and the dispersing medium, and preferably a coagulant and a reinforcing agent for paper into the structure (I) through a papermaking process; and forming a surface layer containing inorganic particles (B), a clay mineral, and the binder (b) on the structure (I) (preferably pre-heat treated at 100 to 300° C., and more preferably at 150 to 250° C.). It is preferable to prepare the structure (I) through a papermaking-having molding step and thereafter forming a surface layer.

The structure for casting of the present invention preferably has the surface layer containing inorganic particles (B) at a content of not less than 50% by mass, more preferably not less than 60% by mass, even more preferably not less than 70% by mass, and still even more preferably not less than 90% by mass.

The structure for casting of the present invention preferably has the surface layer on the surface of the structure (I) at least at a part contacting with a molten metal. For reducing gas defects of a cast metal, the surface layer is preferably formed on the surface of the structure (I) at the side contacting with a molten metal. The surface layer preferably covers not less than 50%, more preferably not less than 80%, even more preferably not less than 90%, and still even more preferably substantially 100% of the surface of the structure (I) at the side contacting with a molten metal.

From the viewpoints of surface sealability on the structure (I) and adhesion between the structure (I) and the surface layer, inorganic particles (B) has an average particle diameter of 1 to 100 μm, preferably 3 to 80 μm, more preferably 3 to 70 μm, even more preferably 3 to 50 μm, still even more preferably 5 to 40 μm, and yet still even more preferably 10 to 30 μm. The average particle diameter of inorganic particles (B)

can be determined by the method of measuring an average particle diameter described for inorganic particles (A), such as the second method for (A).

In the present invention, from the viewpoint of surface sealability on the surface of the structure (I), a ratio of average particle diameters of inorganic particles (A) to (B), [average particle diameter of inorganic particles (A)]/[average particle diameter of refractory inorganic particles (B)], is preferably 1 to 35, more preferably 2 to 30, even more preferably 2 to 20, and still even more preferably 3 to 6.

For the refractory inorganic particles (B), the "refractory" refers to those having a melting point of not less than 1500° C., preferably not less than 1600° C., and more preferably not less than 1700° C. The refractory inorganic particle (B) is selected from metal oxide particles and metal silicate particles. Specific examples of the refractory inorganic particle (B) include particles of mullite, zircon, zirconia, alumina, olivine, spinel, magnesia, and chromite. For reducing gas defects of a cast metal, zircon is preferred. As refractory inorganic particles (B), these particles may be used alone or in combination two kinds or more. For cast steel having a lower carbon content (0.03 to 1.7% C) than cast iron (1.7 to 6.67% C), aggregate particles other than carbonaceous aggregate particles are preferably used. Zircon has a high melting point and a low wettability to a molten metal and is more preferably used.

For achieving effects for reducing gas defects to improve quality of a cast metal and improving properties against sagging, a thickness of the surface layer (wall thickness of the surface layer formed on the surface of the structure (I) after dried) is preferably 1 to 1000 μm, more preferably 5 to 900 μm, even more preferably 20 to 800 μm, and still even more preferably 400 to 600 μm. The thickness of the surface layer can be measured by the method described in Examples below.

The surface layer may also be formed by applying a dispersion (coating liquid composition) containing inorganic particles (B) as a main component, for example, by brushing, spraying, electrostatic coating, baking, flow coating, dipping, French polish, or the like. From the extensive studies for the surface layer about evenness of the thickness, efficiency, and economic efficiency, the dipping is found to be preferred. In the dipping, to form the surface layer on an inner hollow side of a hollow structure such as a hollow core, the hollow part is filled and contacted with a dispersion (coating liquid composition) (hereinafter, referred to as method 1). In cases of forming the surface layer on the structure (I) having an open hollow part by the method 1, it can be formed, for example, by closing at least one open end of the hollow part to make the hollow part hold the dispersion (coating liquid composition) containing inorganic particles (B) as a main component, pouring the dispersion into the hollow part preferably to capacity, allowing to stand for a predetermined time, and draining the coating liquid composition. In any method of application, a temperature of the coating liquid composition is preferably within the range of 5 to 40° C., more preferably 15 to 30° C., and even more preferably 20 to 30° C., and is further preferably maintained at a constant level by setting an apparatus. In the dipping, for example by the method 1, from the point of productivity, a time of standing is preferably within the range of 1 to 60 seconds. The dipping may be conducted batchwise or continuously. In any method of application, to adjust a thickness of the surface layer, the structure (I) coated with the dispersion containing inorganic particles (B) as a main component may be vibrated with a vibration table or the like. To solidify an attachment of inorganic particles (B) on the surface of the structure (I) (preferably preheat treated at 100 to 300° C., and more preferably at 150 to 250° C.), the structure (I) is preferably subjected to a step of drying. Examples of the method of drying include, but not limited to, hot air drying with a heater, far-infrared drying, microwave drying, superheated steam drying, and vacuum drying. In cases of drying with a hot air dryer, a drying temperature at the center of a drying furnace is preferably within the range of 100 to 500° C., and for reducing effects of pyrolysis of organic matters and a binder and for ensuring the safety against ignition, more preferably within the range of 105 to 300° C. In the dispersion containing inorganic particles (B) as a main component, a dispersing medium may be water, an alcohol, or the like. Water is preferred. The dispersing medium is preferably used in an amount of 5 to 100 parts by mass, more preferably 10 to 80 parts by mass, and even more preferably 10 to 20 parts by mass relative to 100 parts by mass of solids in the dispersion.

For increasing hot strength and imparting a viscosity in application, the surface layer further contains a clay mineral. Addition of the clay mineral to a dispersion (coating liquid composition) to form a surface layer imparts an adequate viscosity to the dispersion, thereby preventing sedimentation of components in the dispersion and increasing dispersibility of components. Examples of the clay mineral include layered silicate minerals and double-chain structure minerals, which may be natural or synthetic. Examples of the layered silicate mineral include smectite, kaolin, and illite clay minerals such as bentonite, smectite, hectorite, activated clay, kibushi clay, and zeolite. Examples of the double-chain structure mineral include attapulgite, sepiolite, and palygorskite. For increasing hot strength and securing a viscosity in application, the clay mineral is preferably at least one mineral selected from attapulgite, sepiolite, bentonite, and smectite, and more preferably selected from attapulgite and sepiolite. The clay mineral has a layered or double-chain structure and thus can cause, for example, a hexagonal closest packed structure principally. In this regard, the clay mineral is distinguished from the inorganic particle (B) that generally does not have a layered or double-chain structure. The clay mineral is preferably used in an amount of 0.5 to 30 parts by mass, more preferably 0.5 to 20 parts by mass, and even more preferably 1 to 2 parts by mass relative to 100 parts by mass of inorganic particles (B). The clay mineral added at this ratio that is 0.5 part by mass or more can impart an adequate viscosity to the dispersion to prevent components from settling or floating in the dispersion.

For increasing hot strength, the surface layer further contains the binder (b). For enhancing strength at ambient temperature and heat resistance of the structure for casting, the binder (b) is preferably used when the surface layer is formed. The binder (b) may be an organic or inorganic binder. Examples of the organic binder include phenol resins, epoxy resins, furan resins, water-soluble alkyd resins, water-soluble butyral resins, polyvinyl alcohols, water-soluble acrylic resins, water-soluble polysaccharides, vinyl acetate resins and copolymers thereof. Examples of the inorganic binder include sulfates, silicates, phosphates, lithium silicate, and various sols such as zirconia sol, colloidal silica (silica sol), and alumina sol. The binder (b) is preferably at least one inorganic binder selected from those described above, and more preferably selected from colloidal silica (silica sol) and aluminium phosphate, and even more preferably colloidal silica (silica sol). These binders may be used alone or in combination two kinds or more. An organic binder and an inorganic binder may be used together. The binder (b) is preferably used in an amount of 1 to 50 parts by mass, more preferably 1 to 40 parts by mass, and more preferably 3 to 7 parts by mass, in terms of an effective amount thereof, relative to 100 parts by mass of inorganic particles (B).

For forming the surface layer uniformly fixed on the structure (I), the clay mineral and/or the binder (b) is preferably added in preparation of the dispersion (coating liquid composition) containing inorganic particles (B) as a main component. Thus, the method for producing the structure for casting of the present invention preferably includes a step of applying a coating liquid composition containing inorganic particles (B) and the clay mineral on the surface of the structure (I). The method for producing the structure for casting of the present invention also preferably includes a step of applying a coating liquid composition containing inorganic particles (B) and the binder (b) on the surface of the structure (I). The method for producing the structure for casting of the present invention more preferably includes a step of applying a coating liquid composition containing inorganic particles (B), the clay mineral, and the binder (b) on the surface of the structure (I).

As described above, the coating liquid composition used in producing the structure for casting of the present invention is prepared by adding a dispersing medium, such as water or an alcohol, to solid materials containing inorganic particles (B), the clay mineral, and the binder and stirring to form a slurry. The prepared coating liquid composition is adequately diluted in a dispersing medium such as water or an alcohol, applied on the structure (I) by the means described above, and dried to form the surface layer on the structure (I), thereby providing the structure for casting of the present invention.

The structure for casting of the present invention can be placed in molding sand or backup particles ((shot balls or other particles as a backup of molding sand) to be used as a runner (gating system) or a flow off runner. The structure of the present invention can be used to produce a cast metal having reduced gas defects, and is suitable for producing a steel cast causing gas defects easily in casting.

The present invention uses inorganic particles (A) in the structure (I) and inorganic particles (B) in the surface layer formed on the surface of the structure (I), each having an average particle diameter within the specific range, thereby providing a casting structure that can reduce gas defects of a cast metal. The reason for the reduction of gas defects of a cast metal by the present invention is considered as that: inorganic particles (B) having an adequate average particle diameter and the refractory property enables the surface layer formed on the structure, preferably formed on the surface contacting with a molten metal, to be held during casting without running off, and thus gas is blocked from penetrating into the molten metal, while the gas can be effectively exhausted from the surface not contacting with the molten metal of the structure (I) due to the presence of inorganic particles (A) having an adequate average particle diameter in the structure (I).

In the structure for casting of the present invention, a proportion of the total mass of organic fibers, inorganic fibers, inorganic particles (A), and the binder (a) is preferably not less than 10% by mass, more preferably not less than 20% by mass, even more preferably not less than 30% by mass, and still even more preferably not less than 40% by mass, based on the mass of the structure for casting (structure having the surface layer formed thereon). The proportion is also preferably not more than 80% by mass, more preferably not more than 70% by mass, even more preferably not more than 65% by mass, and still even more preferably not more than 60% by mass, based on the mass of the structure for casting (structure having the surface layer formed thereon).

In the structure for casting of the present invention, respective contents of organic fibers, inorganic fibers, inorganic particles (A), and the binder (a) are preferably within the following ranges.

organic fibers: 1 to 40% by mass, more preferably 2 to 30% by mass, even more preferably 3 to 25% by mass, and still even more preferably 4 to 12% by mass inorganic fibers: 1 to 60% by mass, more preferably 2 to 50% by mass, even more preferably 3 to 40% by mass, still even more preferably 3.5 to 20% by mass, and yet still even more preferably 3.5 to 12% by mass inorganic particles: 1 to 70% by mass, more preferably 2 to 60% by mass, even more preferably 5 to 50% by mass, and still even more preferably 10 to 45% by mass binder (a): 1 to 60% by mass, more preferably 2 to 50% by mass, even more preferably 3 to 40% by mass, still even more preferably 5 to 25% by mass, and yet still even more preferably 6 to 16% by mass In the structure for casting of the present invention, a proportion of the surface layer is preferably 10 to 80% by mass, more preferably 20 to 80% by mass, even more preferably 30 to 70% by mass, still even more preferably 38 to 70% by mass, and yet still even more preferably 38 to 60% by mass, based on the mass of the structure for casting (structure having the surface layer formed thereon).

For decreasing gas defects of a cast metal, in the surface layer, refractory inorganic particles (B) are zircon particles, the clay mineral is attapulgite, and the binder (b) is colloidal silica.

The structure for casting of the present invention is applied, for example, to a mold having a cavity, as described above, and full-mold casting with a polystyrene foam pattern, Lost pattern casting without a binding agent, arts of casting with a main mold or a core and the like, and other arts requiring heat resistance. The structure for casting of the present invention is suitably used as a sprue runner, a flow off runner, or a core.

For increasing effects for blocking a gas from penetrating into the molten metal side, after the surface layer is formed on the structure for casting of the present invention, the structure preferably has the gas permeability of not more than 1, more preferably not more than 0.2, and even more preferably not more than 0.12.

Before the surface layer is formed, the structure (I) preferably has the gas permeability of 0.1 to 500, more preferably 0.3 to 100, even more preferably 0.4 to 10, and still even more preferably 0.5 to 1. The structure (I) having the gas permeability within this range can preferably efficiently exhaust gas from the side not covered with the surface layer, while blocking the gas with the surface layer.

Each gas permeability of the structure for casting and the structure (I) can be measured by the method described in Examples.

A thickness of the structure for casting of the present invention can be appropriately defined according to an intended use of the structure and a part in the structure. At a part contacting with molten metal, the thickness is preferably 0.2 to 5 mm, more preferably 0.2 to 4 mm, even more preferably 0.4 to 4 mm, and still even more preferably 2 to 3 mm. The structure for casting having a thickness of not less than the lower limit can retain its shape and function in casting. The structure having a thickness of not more than the upper limit generates a reduced amount of pyrolysis gas to reduce a potential of cast defect generation.

<Method for Casting>

Next, a preferred embodiment of the method for casting with the structure for casting of the present invention will be described. In this embodiment, for example, the structure for casting of the present invention produced as described above is embedded at a predetermined position in molding sand to build a mold. Any molding sand commonly used for such casting can be used.

A molten metal is poured from a pouring cup and cast. In this time, the structure for casting of the present invention retains its hot strength and causes only a small thermal contraction due to pyrolysis. The structure is thus prevented from clacking or breaking itself, thereby reducing potentials of penetration of the molten metal into the structure for casting and attachment of cast sand.

A cast metal is cooled to a predetermined temperature, a molding flask is released, the molding sand is removed, and the structure for casting is removed by blasting to exposure the cast metal. In this time, the thermosetting resin has already decomposed by heat, and thus the structure for casting can be easily removed. The cast metal is subjected to an aftertreatment such as trimming according to need and finished.

EXAMPLES

The following Examples demonstrate the present invention. Examples are intended to illustrate the present invention, and not to limit the present invention.

Example 1

A raw slurry was used to form fiber laminates by papermaking. Fiber laminates were dehydrated and dried, and used to build a sprue runner 1 (including straight tubes 11 and 12 and elbow tubes 14 and 16, each corresponding to a structure (I)) as shown in FIG. 1 (in millimeters). The structure (I) had a composition as shown in Table 1.

<Preparation of a Raw Slurry>

The raw slurry was prepared as follows. Organic fibers and inorganic fibers of the following compositions were dispersed in water to obtain an aqueous slurry of about 1% by mass fibers (the total mass of organic and inorganic fibers accounted for 1% by mass of the aqueous slurry). To the aqueous slurry, inorganic particles (A), a binder (a), a coagulant, and a reinforcing agent for paper, shown bellow, were added in such amounts that the structure (I) shown in Table 1 might be produced. Based on 100 parts by mass (in terms of solid content) of the total mass of organic fibers, inorganic fibers, inorganic particles (A), and the binder (a), the coagulant was added in amounts of 0.625 part by mass (in terms of solid content) and the reinforcing agent for paper was added in amounts of 0.025 part by mass (in terms of solid content). Components shown in Table 1 are as follows.

<Organic Fibers>

Organic fibers: waste newspaper (average fiber length: 1 mm, freeness: 150 cc)

<Inorganic Fibers>

Inorganic fibers: carbon fiber [Toray Industries, Inc., product name: TORAYCA CHOP, fiber length: 3 mm, fiber width: 11 μm (major-to-minor axis ratio: 273)]

<Inorganic Particles (A)>

Spherical silica: [Micron Co., "S85-P", average particle diameter: 80 μm, apparent specific gravity: 2.2, bulk specific gravity: 1.15]

<Binder (a)>

Phenol resin: [Air Water Bellpearl Inc., Product name: Bellpearl S-890 (Resol type), weight loss on heating at 1000° C. in nitrogen atmosphere: 44% (according to TG thermoanalysis)]

<Coagulant>

Coagulant: polyamide-epichlorohydrin (Seiko PMC Corporation, product name: WS-4002)

<Reinforcing Agent for Paper>

Reinforcing agent for paper: aqueous solution of 1% by mass carboxymethylcellulose <Dispersing Medium>

Dispersing medium: water

<Step of Papermaking and Dehydrating>

Papermaking molds having cavity-forming faces corresponding to the structures described above (straight and elbow tubes) were used. Each cavity-forming face was lined with a net having a predetermined opening size and had many communication holes communicating with the outside. Each papermaking mold was composed of a pair of parts. The raw slurry was circulated with a pump and pressing-injected into each papermaking mold in a predetermined amount of the slurry, while water in the slurry was drained out through the communication holes to form each intended fiber laminate on the net in accumulation. After the injection of each predetermined amount of the raw slurry, compressed air was injected in each papermaking mold to dehydrate each fiber laminate. A pressure of the compressed air was 0.2 MPa, and a time taken to dehydrate was about 30 seconds.

<Step of Drying>

Drying molds having cavity-forming faces corresponding to the structures described above (straight and elbow tubes) were used. Each drying mold had many communication holes communicating the cavity-forming face with the outside. Each drying mold was composed of a pair of parts. Each fiber laminate prepared above was transferred from each papermaking mold to each corresponding drying mold heated to 200° C. Each elastic bag-formed core was inserted from the upper opening of each drying mold, and blown up with compressed air (0.2 MPa) in the closed drying mold to push the fiber laminate on the inner surface of the drying mold, thereby transferring the geometry of the inner surface of the drying mold to the surface of the fiber laminate and simultaneously drying. After drying with pressure for 60 seconds, the compressed air was released from each elastic core to contract the elastic core and remove the core from the dry mold. Each molded product was taken from the drying mold and cooled to obtain a thermally cured structure (I).

<Preparation of a Coating Liquid Composition Containing Inorganic Particles (B) as a Main Component>

A solid material composed of inorganic particles (B), a clay mineral, and a binder (b) at a combination of kind and proportion (mass proportion) as shown in Table 1 and water were mixed for 15 minutes while stirring with a mixer to obtain a coating liquid composition containing inorganic particles (B) as a main component. Components in Table 1 are as follows. Water was used in such amount as that a solid content (% by mass, in Table 1, simply referred to as "%") of a coating liquid composition was adjusted to that shown in Table 1.

<Inorganic Particles (B)>

Zircon: HakusuiTech Co., Ltd., product name: Zircosil No 1, average particle diameter: 20 μm <Clay Mineral>

Attapulgite: Hayashi-Kasei Co., Ltd., product name: Attagel 50

<Binder (b)>

Colloidal silica: Nissan Chemical Industries, Ltd., product name: snowtex50, an average particle diameter: 25 nm <Formation of a Surface Layer>

Each of the thermally cured structures (straight and elbow tubes) was sealed at one open end, filled with the coating liquid composition up to the upper end of the structure, and allowed to stand for 10 seconds. Then, the structure was turned upside down to spill off the coating liquid composition. The structure was naturally dried and further heat dried for 30 minutes at 200° C. with a hot air dryer to obtain a structure for casting having a surface layer formed thereon.

<Method of Measuring the Gas Permeability of Structure (I) and a Structure for Casting>

Figure 2:
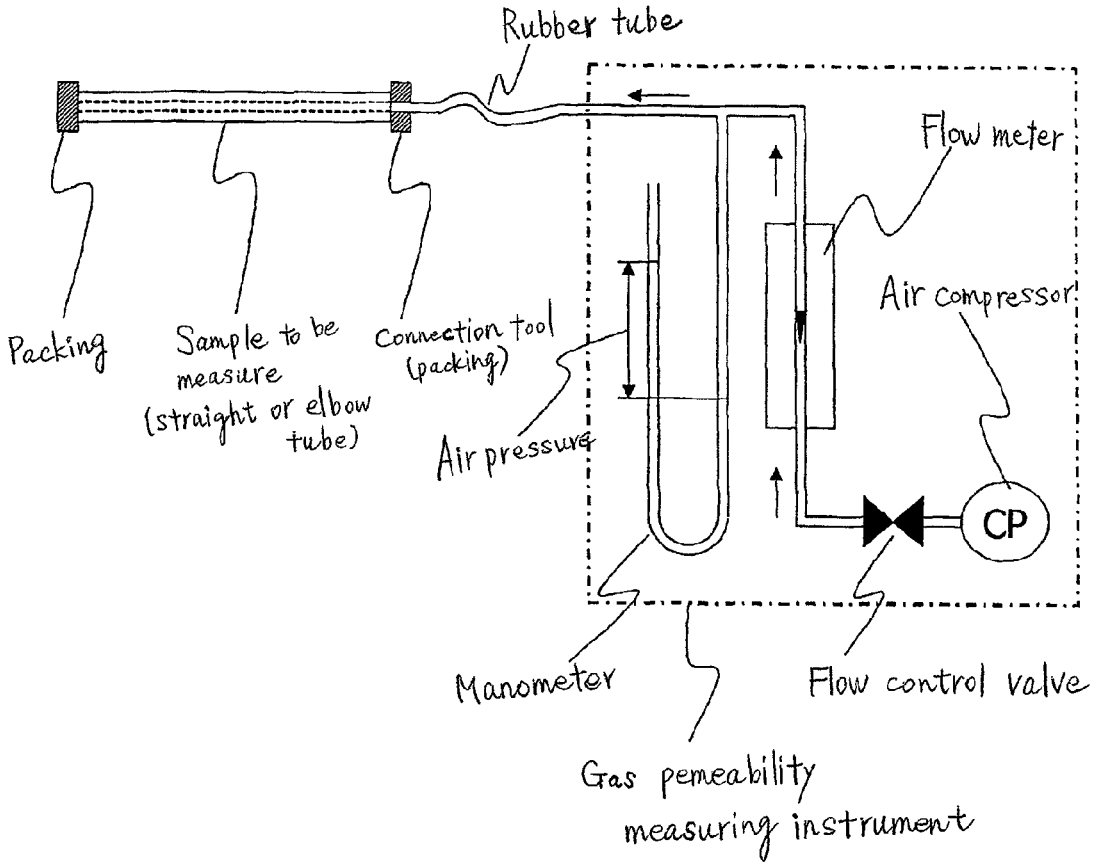
FIG. 2 is a schematic view of a means for measuring the gas permeability used in Examples and Comparative Examples.

A gas permeability was measured according to a method described in "Shoushitsu Mokei you Tokeizai no Hyoujun Shiken Houhou (standard test method for coating agent for lost pattern), Chapter 5: method for measuring a gas permeability", Japan Foundry Engineering Society, Kansai division, March, 1996, based on JIS 22601 (1993), "test method for molding sand", with an apparatus working by the same mechanism as of the apparatus for measuring a gas permeability (compressed air ventilating system) described in this publication (p. 24, FIG. 5-2). A gas permeability P is represented by the formula: $P=(h/(a\times p))xv$, wherein h is a thickness of a sample (cm), a is a cross-sectional area ($cm^2$), p is a ventilation resistance ($cmH_2O$), and v is a flow rate of air ($cm^3$/min).

In the equation, a thickness of a test piece was a wall thickness of a structure (I) or structure for casting (on which a surface layer was formed), or "(outer diameter−inner diameter)/2", and a cross-sectional area of a test piece was "inner diameter×pi×length".

As shown in FIG. 2, in the measurement, the gas permeability measuring instrument was attached with a rubber tube and a connection tool (packing) in order to connect to a hollow part of a produced straight or elbow tube for the sprue runner (in FIG. 2, shown as a sample to be measured) without leakage. The straight or elbow tube was, at one end of the hollow part, tightly fitted with the connection tool, and at the other end, closed with a packing to prevent air from leaking therefrom, and subjected to the measurement. In Example 1, the sprue runner composed of two straight tubes and two elbow tubes was used, and thus the gas permeability of a structure (I) or structure for casting meant an average gas permeability of these four elements individually measured.

<Method of Measuring a Thickness of a Surface Layer>

The thickness of a surface layer formed on the surface of a structure (I) was determined by measuring the difference in thickness between the structure for casting having the surface layer formed thereon and the structure (I) before the surface layer was formed. The thickness of the structure (I) before the surface layer was formed was determined by measuring at ten marked positions, which were arbitrarily selected, with a dial caliper gauge [Mitutoyo Corporation, code No. 209-611, reference number DCGO-50RL] and calculating an average thereof. The thickness of the structure for casting having the surface layer formed thereon was determined by measuring at corresponding ten positions to the marked positions on the structure (I) with a dial caliper gauge [Mitutoyo Corporation, order No. 209-611, code number DCGO-50RL] and calculating an average thereof.

<Measurement of Detachability of a Surface Layer>

Detachability of a surface layer formed on the surface of the structure (I) was determined by scratching the surface of the structure for casting having the surface layer with a plastic cutter to make 84 squares and counting the number of squares in which the surface layer was detached. Six structures were subjected to the measurement to calculate an average number of detached squares. In Table 1, the result is shown in the column of "the number of detached surface layers".

<Casting and Evaluation for Quality of a Cast Metal>

A water-soluble phenol resin mold as shown in FIG. 1 was built, in which a casting runner 1 was constructed using the produced structures for casting and connected to a cavity part 2 producing a toroidal cast component, which had an outer diameter of 240 mm, an inner diameter of 140 mm, and a thickness of 30 mm, and had a flow off.

The casting runner 1 included the straight tube 11 (diameter: 50 mm, length: 150 mm) buried in the upper part of the mold (in FIG. 1, above the mold parting plane) and a composite member buried in the lower part of the mold (in FIG. 1, below the mold parting plane). The composite member included the straight tube 12 (inner diameter: 50 mm, length: 30 mm), the elbow tube 14 (inner diameter: 50 mm, height: 70 mm, width: 90 mm), a fitting member 13 (inner diameter: 53 mm, length: 45 mm) connecting the straight tube 12 with the elbow tube 14, the elbow tube 16 (inner diameter: 50 mm, height: 70 mm, width: 110 mm), and a fitting member 15 (inner diameter: 53 mm, length: 45 mm) connecting the elbow tube 14 at the other end with the elbow tube 16. The straight tubes 11 and 12 were positioned such that these coincided with each other's bore and communicated each other when the upper part of the mold was laid on the lower part to form the mold. The fitting members 13 and 15 were made of the same material as that used to produce the structure (I) in each of Examples and Comparative Examples, and had the same thickness.

To form the mold, a new sand (Kao-Quaker Co., Ltd., "Lunamos #60"), 1.1 parts by mass of water-soluble phenol resin (Kao-Quaker Co., Ltd., "Kao Step SL6000, relative to 100 parts by mass of the sand), 20 parts by mass of curing agent (Kao-Quaker Co., Ltd., "DH-15", relative to 100 parts by mass of the water-soluble phenol resin) were used.

A casting mass was 20 kg, and a mold mass was 100 kg.

After produced a cast steel (SCW480, casting temperature: 1550 to 1580° C.), the mold was examined whether the surface layer remained in the mold or not, and the result was shown in the column of "survival of surface layer".

The cast steel was subjected to x-ray transmission imaging to measure an area of gas defects in the cast steel. An image analyzing software "Winroof" was used to calculate an area of gas defects in the cast steel. The smaller area of gas defects in a cast steel means the cast steel has the higher quality with the less gas defects. The result is shown in Table 1.

Example 2

Structures for casting were produced and used to cast a molten metal in the same way as in Example 1, except that the molten metal was SCS11 (stainless cast steel). Evaluation results of the structures by the same methods as in Example 1 are shown in Table 1.

Example 3

Structures for casting were produced and used to cast a molten metal in the same way as in Example 1, except that the molten metal was SCS13 (stainless cast steel). Evaluation results of the structures by the same methods as in Example 1 are shown in Table 1.

Example 4

Structures for casting were produced and used to cast a molten metal in the same way as in Example 2, except that hollow ceramic particles [Taiheiyo Cement Corporation, product name: E-SPHERES SL125, average particle diameter: 80 μm, apparent specific gravity: 0.8, bulk specific gravity: 0.34] were used as inorganic particles (A) and each structure (I) had a composition as shown in Table 1. Evaluation results of the structures by the same methods as in Example 1 are shown in Table 1.

Example 5

Structures for casting were produced and used to cast a molten metal in the same way as in Example 4, except that the molten metal was SCS13 (stainless cast steel). Evaluation results of the structures by the same methods as in Example 1 are shown in Table 1.

Comparative Example 1

Structures for casting were produced in the same way as in Example 1, except that mullite particles [Itochu Ceratech Corp., product name: Synthetic Mullite MM-200 mesh, average particle diameter: 20 μm, apparent specific gravity: 2.8, bulk specific gravity: 0.89] were used as inorganic particles (A), each structure (I) had a composition as shown in Table 1, and a surface layer was not formed on the surface of the structure (I). Evaluation results of the structures by the same methods as in Example 1 are shown in Table 1.

Comparative Example 2

Structures for casting were produced in the same way as in Example 1, except that mullite particles [Itochu Ceratech Corp., product name: Synthetic Mullite MM-200 mesh, average particle diameter: 20 μm, apparent specific gravity: 2.8, bulk specific gravity: 0.89] were used as inorganic particles (A), each structure (I) had a composition as shown in Table 1, and a surface layer was formed using colloidal silica [Nissan Chemical Industries, Ltd., product name: snowtex 50, average particle diameter: 25 nm, solid content: 50%]. Evaluation results of the structures by the same methods in Example 1 are shown in Table 1. For convenience, the colloidal silica was shown in the column "refractory inorganic particles (B)" in Table 1.

Comparative Example 3

Structures for casting were produced in the same way as in Example 1, except that mullite particles [Itochu Ceratech Corp., product name: Synthetic Mullite MM-200 mesh, average particle diameter: 20 μm, apparent specific gravity: 2.8, bulk specific gravity: 0.89] were used as inorganic particles (A) and each structure (I) had a composition as shown in Table 1. Evaluation results of the structures by the same methods as in Example 1 are shown in Table 1.

Comparative Example 4

Structures for casting were produced in the same way as in Example 1, except that spherical silica particles having an average particle diameter of 40 μm [Nippon Steel Materials Co., Ltd. Micron Co., "SC30", apparent specific gravity: 2.2, bulk specific gravity: 1.04] were used as inorganic particles (A). Evaluation results of the structures by the same methods as in Example 1 are shown in Table 1.

Comparative Example 5

Structures for casting were produced in the same way as in Example 1, except that obsidian particles having an average particle diameter of 30 μm [Kinsei Matec Co., Ltd., "Nice Catch Flour #330", apparent specific gravity: 2.3, bulk specific gravity: 0.58] were used as inorganic particles (A) and each structure (I) had a composition as shown in Table 1. Evaluation results of the structures by the same methods as in Example 1 are shown in Table 1.

Comparative Example 6

Structures for casting were produced in the same way as in Example 1, except that titanium powder (screened powder through a 45 μm-mesh filter, an average particle diameter was shown as "less than 45" in Table 1) was used as inorganic particles (B). Evaluation results of the structures by the same methods as in Example 1 are shown in Table 1.

TABLE 1

| | Structure for casting Structure (I) | | | | | | | | | | |
|---|---|---|---|---|---|---|---|---|---|---|---|
| | Composition | | | | | | | | | | |
| | | | | | Inorganic particle (A) | | | | | | |
| | Organic fiber | | Inorganic fiber | | | | | | Binder (a) | | |
| | Kind | % by Mass | Kind | % by Mass | Kind | % by Mass | Average particle diameter (μm) | Apparent specific gravity | Kind | % by Mass | Mass (g) |
| Example | | | | | | | | | | | |
| 1 | Waste news paper | 10.2 | Carbon fiber | 8.5 | Spherical silica | 66 | 80 | 2.2 | Phenol resin | 15.3 | 122 |
| 2 | Waste news paper | 10.2 | Carbon fiber | 8.5 | Spherical silica | 66 | 80 | 2.2 | Phenol resin | 15.3 | 134 |
| 3 | Waste news paper | 10.2 | Carbon fiber | 8.5 | Spherical silica | 66 | 80 | 2.2 | Phenol resin | 15.3 | 137 |
| 4 | Waste news paper | 19 | Carbon fiber | 16 | Hollow ceramic | 36.5 | 80 | 0.8 | Phenol resin | 28.6 | 80 |

TABLE 1-continued

| | | | | | | | | | | | |
|---|---|---|---|---|---|---|---|---|---|---|---|
| 5 | Waste news paper | 19 | Carbon fiber | 16 | Hollow ceramic | 36.5 | 80 | 0.8 | Phenol resin | 28.6 | 82 |
| Comparative example | | | | | | | | | | | |
| 1 | Waste news paper | 12 | Carbon fiber | 10 | Mullite | 60 | 20 | 2.8 | Phenol resin | 18 | 125 |
| 2 | Waste news paper | 12 | Carbon fiber | 10 | Mullite | 60 | 20 | 2.8 | Phenol resin | 18 | 105 |
| 3 | Waste news paper | 12 | Carbon fiber | 10 | Mullite | 60 | 20 | 2.8 | Phenol resin | 18 | 130 |
| 4 | Waste news paper | 10.2 | Carbon fiber | 8.5 | Spherical silica | 66 | 37 | 2.2 | Phenol resin | 15.3 | 122 |
| 5 | Waste news paper | 12 | Carbon fiber | 10 | Obsidian | 60 | 30 | 2.3 | Phenol resin | 15.3 | 122 |
| 6 | Waste news paper | 10.2 | Carbon fiber | 8.5 | Spherical silica | 66 | 80 | 2.2 | Phenol resin | 15.3 | 122 |

| | Structure for casting | | | | | | | | | | |
|---|---|---|---|---|---|---|---|---|---|---|---|
| | | | Surface layer | | | | | | | | |
| | | | Composition | | | | | | | | |
| | | | Refractory inorganic partical (B) | | | | | | | | |
| | Structure (I) | | | Average | | Clay mineral | | Binder (b) | | | |
| | Thick-ness (mm) | gas perme-ability | Kind | particle diameter (μm) | part by mass | Kind | part by mass | Kind | part by mass | Solid content (%) | Condition of drying |
| Example | | | | | | | | | | | |
| 1 | 1.94 | 0.6 | Zircon | 17.3 | 100 | Attapul-gite | 1.25 | Colloidal silica | 5 | 86 | 30 minutes at 200° C. |
| 2 | 1.85 | 0.6 | Zircon | 17.3 | 100 | Attapul-gite | 1.25 | Colloidal silica | 5 | 86 | 30 minutes at 200° C. |
| 3 | 1.92 | 0.6 | Zircon | 17.3 | 100 | Attapul-gite | 1.25 | Colloidal silica | 5 | 86 | 30 minutes at 200° C. |
| 4 | 2.08 | 0.8 | Zircon | 17.3 | 100 | Attapul-gite | 1.25 | Colloidal silica | 5 | 87 | 30 minutes at 200° C. |
| 5 | 2.02 | 0.8 | Zircon | 17.3 | 100 | Attapul-gite | 1.25 | Colloidal silica | 5 | 87 | 30 minutes at 200° C. |
| Comparative example | | | | | | | | | | | |
| 1 | 1.81 | 0.15 | — | — | — | — | — | — | — | — | — |
| 2 | 1.35 | 0.15 | Col-loidal silica | 0.025 | — | — | — | — | — | 50 | 30 minutes at 200° C. |
| 3 | 1.83 | 0.15 | Zircon | 17.3 | 100 | Attapul-gite | 1.25 | Colloidal silica | 5 | 84 | 30 minutes at 200° C. |
| 4 | 1.91 | 0.6 | Zircon | 17.3 | 100 | Attapul-gite | 1.25 | Colloidal silica | 5 | 84 | 30 minutes at 200° C. |
| 5 | 1.51 | 0.6 | Zircon | 17.3 | 100 | Attapul-gite | 1.25 | Colloidal silica | 5 | 84 | 30 minutes at 200° C. |
| 6 | 1.96 | 0.6 | Tita-nium powder | Less than 45 | 100 | Attapul-gite | 1.25 | Colloidal silica | 5 | 84 | 30 minutes at 200° C. |

TABLE 1-continued

| | Structure for casting | | | | | | |
|---|---|---|---|---|---|---|---|
| | Surface layer | | | | | Cast metal | |
| | Thickness of the surface layer (μm) | The number of detached layer | Survival of surface layer | gas perme-ability | mass (g) | Material of molten metal | Area of internal defect (cm2) |
| Example | | | | | | | |
| 1 | 474 | 3.6 | remaining | 0.1 | 218 | SCW 480 | 2.4 |
| 2 | 538 | 3.6 | remaining | 0.08 | 231 | SCS 11 | 1.4 |
| 3 | 483 | 3.6 | remaining | 0.08 | 227 | SCS 13 | 0.7 |
| 4 | 501 | 0 | remaining | 0.09 | 185 | SCS 11 | 1.3 |
| 5 | 507 | 0 | remaining | 0.08 | 189 | SCS 13 | 1.9 |
| Comparative example | | | | | | | |
| 1 | — | — | — | 0.15 | 125 | SCW 480 | 42.4 |
| 2 | 51 | 0 | Not remaining | 0.13 | 106 | SCW 480 | 48.8 |
| 3 | 453 | 42 | remaining | 0.08 | 221 | SCW 480 | 5.3 |
| 4 | 480 | 37 | remaining | 0.08 | 220 | SCW 480 | 5.5 |
| 5 | 490 | 35 | remaining | 0.08 | 215 | SCW 480 | 6.2 |
| 6 | 450 | 40 | Not remaining | 0.1 | 220 | SCW 480 | 30 |

The invention claimed is:

1. A structure for casting, comprising an organic fiber, an inorganic fiber, inorganic particles (A) having an average particle diameter of 50 to 150 μm, and a binder (a);

and said structure having a surface layer comprising refractory inorganic particles (B) having an average particle diameter of 1 to 100 μm selected from the group consisting of metal oxides and metal silicates, a clay mineral, and a binder (b), on a surface of the structure contacting with a molten metal.

2. The structure for casting according to claim 1, wherein a ratio of the average particle diameter of inorganic particles (A) to refractory inorganic particles (B), [average particle diameter of inorganic particles (A)]/[average particle diameter of refractory inorganic particles (B)], is 1 to 35.

3. The structure for casting according to claim 1, wherein a proportion of the clay mineral is 0.5 to 30 parts by mass relative to 100 parts by mass of inorganic particles (B).

4. The structure for casting according to claim 1, wherein a proportion of the surface layer is 10 to 80% by mass of the structure for casting, based on the mass of the structure for casting.

5. The structure for casting according to claim 1, wherein the inorganic particle (A) is at least one selected from the group consisting of graphite, mica, silica, hollow ceramics and fly ash.

6. The structure for casting according to claim 1, wherein refractory inorganic particles (B) is at least one selected from the group consisting of mullite, zircon, zirconia, alumina, olivine, spinel, magnesia and chromite.

7. The structure for casting according to claim 1, wherein the clay mineral is at least one selected from the group consisting of attapulgite, sepiolite, bentonite and smectite.

8. The structure for casting according to claim 1, wherein the binder (b) is an inorganic binder.

9. The structure for casting according to claim 1, wherein the surface layer comprises zircon particles as the refractory inorganic particles (B), attapulgite as the clay mineral, and colloidal silica as the binder (b).

10. A method for producing a structure for casting, comprising steps of:

preparing a structure (I) from a raw slurry comprising an organic fiber, an inorganic fiber, inorganic particles (A) having an average particle diameter of 50 to 150 μm, a binder (a) and a dispersing medium through a papermaking; and forming a surface layer comprising refractory inorganic particles (B) having an average particle diameter of 1 to 100 μm selected from the group consisting of metal oxides and metal silicates, a clay mineral, and a binder (b) on a surface of the structure (I) contacting with a molten metal.

11. A process for casting a cast article with the structure for casting according to claim 1.

12. The structure for casting according to claim 1, comprising the organic fiber in 3 to 25% by mass, the inorganic fiber in 3.5 to 20% by mass, the inorganic particles (A) in 1 to 70% by mass and the binder (a) in 3 to 40% by mass.

13. The structure for casting according to claim 1, wherein the organic fiber is waste paper pulp.

14. The structure for casting according to claim 1, wherein the inorganic fiber is carbon fiber.

15. The structure for casting according to claim 1, wherein the average particle diameter of the inorganic particles (A) is 70 to 90 μm.

16. The structure for casting according to claim 1, wherein the average particle diameter of the inorganic particles (B) is 3 to 50 μm.

17. The method for producing a structure for casting according to claim 10, wherein the thickness of the structure is 1.5 to 2.5 mm.

18. The method for producing a structure for casting according to claim 10, wherein the thickness of the surface layer is 400 to 600 μm.

* * * * *